US009611709B2

(12) United States Patent
O'Malley

(10) Patent No.: US 9,611,709 B2
(45) Date of Patent: Apr. 4, 2017

(54) CLOSED LOOP DEPLOYMENT OF A WORK STRING INCLUDING A COMPOSITE PLUG IN A WELLBORE

(71) Applicant: Edward J. O'Malley, Houston, TX (US)

(72) Inventor: Edward J. O'Malley, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 332 days.

(21) Appl. No.: 13/927,948

(22) Filed: Jun. 26, 2013

(65) Prior Publication Data

US 2015/0000900 A1 Jan. 1, 2015

(51) Int. Cl.

| | |
|---|---|
| ***E21B 23/10*** | (2006.01) |
| ***E21B 43/11*** | (2006.01) |
| ***E21B 47/10*** | (2012.01) |

(52) U.S. Cl.

CPC ..... *E21B 23/10* (2013.01); *E21B 43/11* (2013.01); *E21B 47/101* (2013.01)

(58) Field of Classification Search

CPC ..... E21B 23/06; E21B 23/08; E21B 23/10; E21B 43/11; E21B 47/12; E21B 47/101

See application file for complete search history.

(56) References Cited

U.S. PATENT DOCUMENTS

| | | | | |
|---|---|---|---|---|
| 5,332,048 | A | 7/1994 | Underwood et al. | |
| 5,842,149 | A | 11/1998 | Harrell et al. | |
| 6,233,524 | B1 | 5/2001 | Harrell et al. | |
| 6,662,110 | B1 | 12/2003 | Bargach et al. | |
| 6,851,444 | B1 | 2/2005 | Kohl | |
| 7,086,481 | B2 | 8/2006 | Hosie | |
| 2007/0007016 | A1 | 1/2007 | Sanderlin | |
| 2007/0181304 | A1* | 8/2007 | Rankin et al. | 166/297 |
| 2008/0128133 | A1* | 6/2008 | Turley et al. | 166/281 |
| 2010/0101787 | A1* | 4/2010 | McCoy et al. | E21B 43/121 166/250.03 |
| 2011/0090091 | A1 | 4/2011 | Lerche | |
| 2013/0056200 | A1* | 3/2013 | Martinez et al. | 166/250.04 |
| 2013/0138254 | A1* | 5/2013 | Seals et al. | 700/282 |

FOREIGN PATENT DOCUMENTS

| | | | | |
|---|---|---|---|---|
| WO | WO-2014/014438 A1 * | 1/2014 | ..... | E21B 45/00 |

OTHER PUBLICATIONS

International Search Report and Written Opinion for International Application No. PCT/US2014/039062; International Filing Date May 22, 2014; Mail Date Sep. 15, 2014 (15 Pages).

* cited by examiner

*Primary Examiner* — Blake Michener
*Assistant Examiner* — Christopher Sebesta
(74) *Attorney, Agent, or Firm* — Cantor Colburn LLP

(57) ABSTRACT

An apparatus for use in a wellbore is disclosed. The apparatus includes a downhole tool coupled to a wireline for conveying the downhole tool into the wellbore and for providing a data communication between the downhole tool and a surface device. The downhole tool further includes a settable device, a setting tool for setting the settable device in the wellbore, a sensor that provide measurements relating to downhole parameter, and a controller for determining the downhole parameter from the measurements and in response thereto altering an operation parameter.

12 Claims, 3 Drawing Sheets

CLOSED LOOP DEPLOYMENT OF A WORK STRING INCLUDING A COMPOSITE PLUG IN A WELLBORE

BACKGROUND

1. Field of the Disclosure

The disclosure relates generally to apparatus and methods for completing wells for the production of hydrocarbons from earth formations 2. Description of the Related Art Hydrocarbons, such as oil and gas, are recovered from subterranean formations from a well (also referred to as wellbore) or wells drilled into such formations. Hydrocarbons are typically present in the fluid trapped at various formation depths. Such fluid is generally referred to as the formation fluid. After drilling a wellbore to a selected depth, a casing is often placed in the wellbore and the space between the casing and the wellbore inside (commonly referred to as the "annuls") is filled with cement. Often, hydrocarbons are trapped in spaced apart zones or segment of the formations surrounding the wellbore. Such zones are referred to as production zones. In horizontal wells, hydrocarbons are typically recovered at several (often 4-10) spaced apart sections or segments along the horizontal well. A production string is conveyed inside the casing to produce hydrocarbons from each zone. A production string may include a base pipe or tubing and various types of production equipment, such as sand screens, inflow control devices, flow control valves, etc. for each perforated zone. Before a production string is installed in the wellbore, casing and cement adjacent each zone is perforated and the adjacent zones are fluidly isolated from each other to allow the formation fluid to flow from each such zone into the production tubing. To perforate and isolate adjacent production zones, a downhole tool (also referred to as a bottomhole assembly or "BHA") connected to a wireline is conveyed into the wellbore by pumping a fluid under pressure into the wellbore. The downhole assembly typically includes a plug, such as bridge plug, a setting tool for setting the plug at a selected location and perforating gun or tool uphole of the plug. The bottomhole assembly is conveyed adjacent the lowermost production zone, where the plug is set to isolate the wellbore beyond below or downhole of the plug location. The setting tool detaches from the plug during the setting of the plug. The zone (casing and the formation) above or uphole of the plug is the perforated using the perforating tool to produce the fluid from the reservoir adjacent the perforations. The power to the downhole tool is provided from the surface via conductors in the wireline. The wireline also includes communication links or conductors that may be utilized for transmission of data between the downhole tool and surface instruments. In commonly used systems, an operator, typically employed by a rig operator, controls the supply of the fluid into the wellbore by controlling pumps at the surface. Another operator, typically employed by a service company, controls the tension on the wireline during pumping of the fluid into the wellbore. The combination of the fluid flow rate and the tension on the wireline determined the rate of travel (travel rate) of the downhole assembly into the wellbore. The tension and pump rate are typically defined or agreed upon by the operators and then used to convey the downhole assembly to a selected depth, generally without real time knowledge or feed-back about the conditions of the wellbore at or near the location of the downhole assembly, which assembly may be traveling several hundred meters per hour. In deviated and horizontal wellbore, obstructions in the form of cuttings and sand are present on the low side of the wellbore. Such obstructions reduce the inner dimensions of the wellbore and when the downhole encounters such obstruction at relatively high travel rates can cause the setting tool in the downhole tool to set the plug prematurely. Excessive travel rate, vibration, acceleration or a combination of such parameters of the downhole tool can also prematurely set the plug, cause the wireline to be detached from the downhole tool and can be detrimental to the health of the downhole tool downhole.

The present disclosure provides apparatus and methods for determining wellbore conditions during pumping of a downhole assembly coupled to a conveying member into a wellbore and for controlling and/or optimizing pump rate and tension on the conveying member for controlling the feed rate of the downhole assembly into the wellbore.

SUMMARY

In one aspect an apparatus for use in a wellbore is disclosed that in one embodiment includes a downhole tool coupled to a wireline for conveying the downhole tool into the wellbore and for providing a data communication between the downhole tool and a surface device, wherein the downhole tool further includes a settable device, a setting tool for setting the settable device in the wellbore, a sensor that provide measurements relating to a downhole parameter of interest, and a controller for determining the downhole parameter of interest from the measurements and in response thereto altering an operating parameter that may include one or more of: flow rate of a fluid supplied into the wellbore for conveying the downhole tool into the wellbore; a tension on the wireline; and a combination of the flow rate of the fluid into the wellbore and the tension on the wireline.

In another aspect, a method of performing a completion operation in a wellbore is disclosed that in one embodiment may include: conveying a work string into the wellbore, wherein the work string includes a downhole tool coupled to a wireline and wherein the downhole tool further includes a settable device; supplying a fluid into the wellbore to convey the downhole tool to a selected location in the wellbore while controlling a tension on the wireline; determining a downhole parameter of interest using measurements of a sensor in the wellbore; and altering a parameter relating to conveying of the downhole tool in response to the determined downhole parameter of interest that includes at least one of: altering flow rate of the fluid supplied into the wellbore; altering the tension on the wireline; and a combination of a change in a flow rate of the fluid supplied into the wellbore and the tension on the wireline.

Examples of some features of the disclosure have been summarized rather broadly in order that detailed description thereof that follows may be better understood, and in order that some of the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters generally designate like or similar elements throughout the several figures, and wherein.

DETAILED DESCRIPTION

Figure 1:
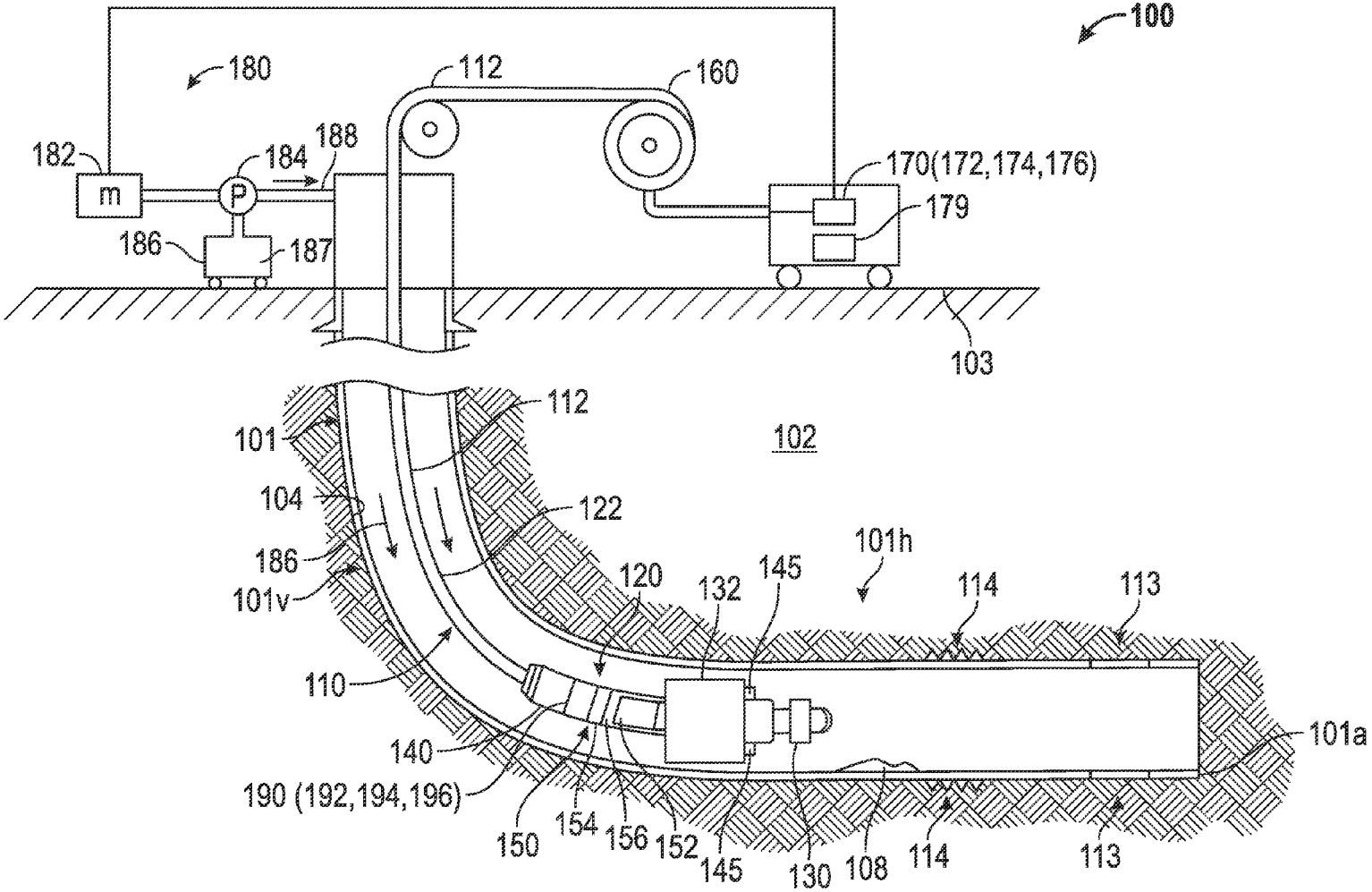
FIG. 1 is a schematic elevation view of an exemplary wellbore system that includes a work string (having a plug, a setting tool, a perforating device and sensors) being conveyed from a surface location into a wellbore, according to one embodiment of the disclosure.

The present disclosure relates to devices and methods for controlling production of hydrocarbons in wellbores. The present disclosure is susceptible to embodiments of different forms. There are shown in the drawings, and herein described, specific embodiments of the present disclosure with the understanding that the present disclosure is to be considered an exemplification of the principles of the devices and methods described herein and is not intended to limit the disclosure to the specific embodiments. Also, the feature or a combination of features should not be construed as essential unless expressly stated as essential.

FIG. 1 is a schematic elevation view of an exemplary wellbore system 100 that includes a work string 110 shown conveyed in a wellbore 101 formed in a formation 102 from a surface location 103 to a depth 101*a*. The wellbore 101 is shown lined with a casing 104. In aspects, the work string 110 includes a conveying member 112, such as an electric wireline, and a downhole tool or assembly 120 (also referred to as the bottomhole assembly or "BHA") attached to the bottom end 112*a* of the wireline. In one aspect, the downhole assembly 110 includes a settable device 130, such as a bridge plug or a packer plug, a setting tool 132 configured to set the settable device 130 in the wellbore 101 when it is activated, such as from the surface. The downhole assembly is further shown to include a perforating device or tool 140 configured to perforate the casing 104 and the formation 102 at desired or selected locations. The downhole assembly 110 also includes sensors, including, but not limited to, an acoustic sensor 145 that provides measurements or information relating to a condition of the wellbore 101 ahead of the plug 130 or the setting tool 132 and other sensors 150 that may include accelerometers 152, vibration sensors 154, fluid flow rate sensors 156, etc.

In one aspect, the downhole assembly 110 is utilized to set the plug 130 into the wellbore 101 at a selected location and then to perforate a section or zone of the formation so that (1) the wellbore below or downhole of the perforations may be isolated from the wellbore above the perforations and (2) to allow the fluids, such as hydrocarbons, to flow from the formation into the wellbore via the perforations. To perform such operations in deviated or horizontal wells, the downhole assembly 110 is typically conveyed into the wellbore 101 by conveying the downhole assembly 110 via the wireline 112 into the wellbore to a location in the vertical section 101*v* of the wellbore. FIG. 1 show a fluid pumping system 180 at the surface 103 that includes a motor 182 that operated a pump 184 to pump a fluid 186 from a source 187 thereof into the wellbore 101 via a supply line or conduit 188. To control the rate of travel of the downhole assembly, tension on the wireline 112 is controlled at a winch 160 on the surface. Thus, the combination of the fluid flow rate and the tension on the wireline defines the travel rate or rate of penetration of the downhole assembly 120 into the wellbore 101. The wireline 112 may be an armored cable that includes conductors for supplying electrical energy (power) to downhole devices and communication links for providing two-way communication between the downhole tool and surface devices. In aspects, a controller 170 at the surface is provided to control the operation of the pump 182 and the winch 160 to control the fluid flow rate into the wellbore and the tension on the wireline 112. In aspects, the controller 170 may be a computer-based system that may include a processor 172, such as a microprocessor, a storage device, such as a memory device, and programs and instructions 176, accessible to the processor 172 for executing the instructions utilizing the data stored in the memory 174.

An exemplary method of operation of the work string 110 is described below relating to setting of the plug 130 at a selected location 113 in the wellbore section 101*h* and perforating a section 114 above or uphole of the plug location 113 in reference to FIGS. 1-3. To set the plug 130 at location 113, the downhole assembly 120 is conveyed into the wellbore section 101*v* to a location and the fluid 186 is then supplied under pressure by the pump unit 180 at a selected rate. The tension on the wireline 112 is simultaneously controlled at the winch 160 to control the travel rate of the downhole assembly 120 into the wellbore 101. Sometimes, wellbores have obstructions, such as reduction in internal dimensions caused by sand and/or cutting accumulations, generally on the low side of the wellbore, such as shown at location 108 in the wellbore 101. Sensors 150 provide information relating to any interface change in the wellbore, indication an obstruction or reduction in an inner dimension of the wellbore. In aspects, acoustic sensors (transducers) may be placed on the downhole assembly, such as around the setting tool 132 in a manner that they direct the transmitted acoustic signals into the wellbore ahead of the plug 130. The reflected signals are then received from any interface change, such as the obstruction at location 108, which signals are processed to determine the location of the obstruction 108 in front of the plug 130. In another aspect, a tactile sensor 151 may be used to determine the internal dimensions of the wellbore proximate to the plug 130. Other sensors, such as accelerometers 152 provide measurements relating to the travel rate of the downhole assembly 120 in the wellbore 101, vibration sensors 154 provide measurements relating to the vibration of the downhole assembly 120 while travelling in the wellbore. Any other sensor may be utilized for determining a condition of the wellbore and/or a condition of the downhole assembly 120. A flow meter 156 may also be provided to determine the fluid flow rate proximate to the downhole assembly 120.

The data from the various sensors 145, 150 may be processed, at least partially, by a circuit 190, which circuit may include circuits 192 for conditioning, pre-processing and digitizing the sensor signals, a processor 194 for processing or partially processing such digitized signals and transmitting them to the surface controller 170 according to the instruction contained in programs 196 provided to the processor 194. In other aspect, the data from the sensors may be transmitted in any desired form to the surface controller 170 via communication links in the wireline 112. In one aspect, the controller 170 at the surface determines the conditions of the wellbore (such as an impending obstruction or another undesirable condition), vibration and acceleration, the fluid flow rate at the surface and/or downhole, the tension on the wireline 112 at the winch 160 and provides such information or displays it on a monitor 179 for use by the operator. Typically, currently an operator of a rig operator controls the pumps and another operator of a service company controls the tension on the wireline. In one embodiment of the disclosure, a common operator may view the condition of the wellbore, and the conditions of the downhole assembly provided by the controller and control the fluid flow rate and/or the tension on the wireline to control the travel rate of the downhole assembly 130 to a rate to avoid undesirable impact with an obstruction, such as obstruction 108, or to maintain the vibration and any other parameter relating to the downhole assembly within selected ranges. In another aspect, the controller 170 may be configured to alter the pump rate (the fluid flow rate) and the tension on the wireline 112 in response to one or more parameters relating to the condition of the wellbore and/or the downhole assembly 120. In one aspect, look-up tables or algorithms may be provided for the controller 170 to select a desired (including an optimal or optimum) combination of the travel rate of the downhole assembly (pump rate) and vibration for normal operation and also desired rates in response to an impending obstruction or undesirable condition in the wellbore. This method enables safe deployment of the downhole assembly in the wellbore, avoiding accidental or premature setting of the plug 130 in the wellbore and damage to the components of the downhole assembly due to excessive vibration and acceleration and other detrimental conditions.

Still referring to FIG. 1, the fluid 186 is supplied into the wellbore 101 while maintaining the tension on the wireline as described above. The downhole assembly is conveyed so that the plug 130 is at the selected location 113. The setting 132 tool is then activated from the surface to set the plug at location 113, as shown by dotted line 130*a*. Setting or activating the plug 130 causes the setting tool 132 to be disconnected from the plug 130, as shown in FIG. 3. The downhole tool 120*a*, without the plug 130, is then moved uphole so that the perforating guns 140 are adjacent the zone 114 to be perforated. The perforating guns 140 are then activated from the surface to cause the perforations 140*a* into the casing 104 and the formation 102 along the zone 114, as shown in FIG. 3. The wireline 112 and the downhole tool 120 may then be retrieved to the surface and may be made ready for a subsequent operation. To perforate another zone uphole of the zone 114, a ball may be dropped to close any passage, such as passage 131 in the already installed plug. The downhole assembly may then be conveyed in the wellbore, as described above to place another plug uphole of the perforation 140*a* and perforate another zone uphole of the newly set plug. Such a procedure may be repeated until all zones have been perforated.

Thus, in various aspects, the disclosure provides apparatus and methods for conveying and controlling the conveying of a downhole tool on a conveying member, such as an electric wireline, into a wellbore in response to real time measurements provided by one or more sensors in the wellbore relating to one or more conditions in the wellbore and/or one or more conditions of the downhole tool while it is traveling in the wellbore. In aspects, a single operator may control the conveying parameter, such as fluid flow rate and the tension on the wireline utilizing the real time information and/or a controller may be configured to automatically control the conveying of the downhole tool in response to the real time determined conditions of the wellbore and/or the downhole tool. Any number of desired sensors may be utilized, including, but not limited to: acoustic transducers (such as those used in fish finders in the wellbore) for determining for wellbore obstructions; contact or non-contact calipers (tactile sensors) for measuring the borehole diameter; flow measurement sensors; accelerometers for determining acceleration; vibration sensor; and velocity sensors for measuring the travel rate of the downhole assembly. With real-time transmission of the conditions of and around the downhole assembly, surface pump rate and wireline feed-rate may be controlled and varied in a feedback control loop. For example, if acoustic sensors detect a sand plug in the casing, pump flow rate may be reduced and wireline drum brake applied in advance of collision with the plug or the downhole tool. If wellbore restrictions are detected, flow rate and wireline feed rate may also be metered to slow the downhole assembly travel rate to allow it safely pass through tight spots. The results of each plug transit may also be utilized to improve the run speed and success rate of any subsequent plug runs.

Figure 2:
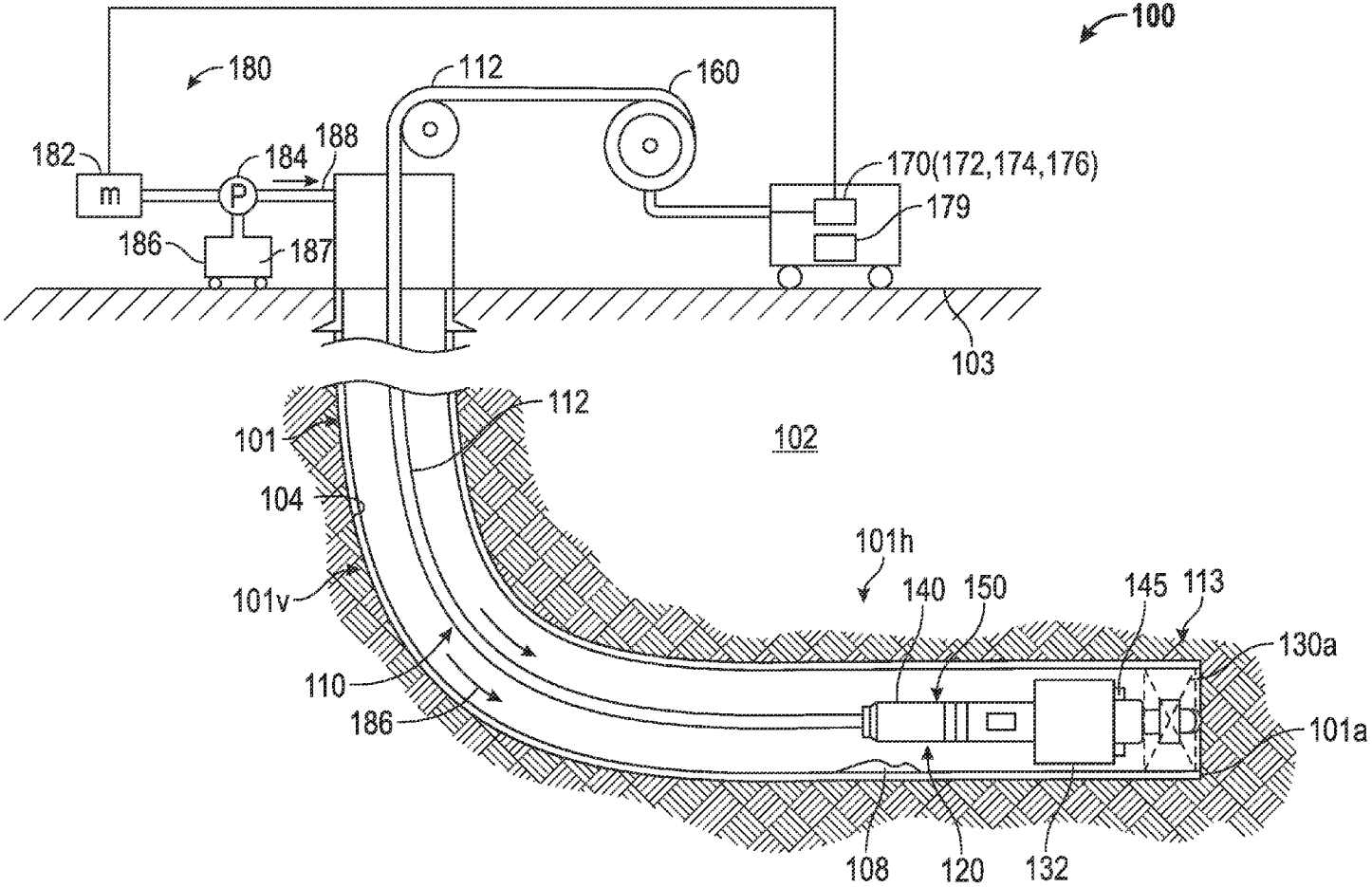
FIG. 2 is a schematic elevation view of the exemplary wellbore system shown in FIG. 1 after the plug has been set in the wellbore.
Figure 3:
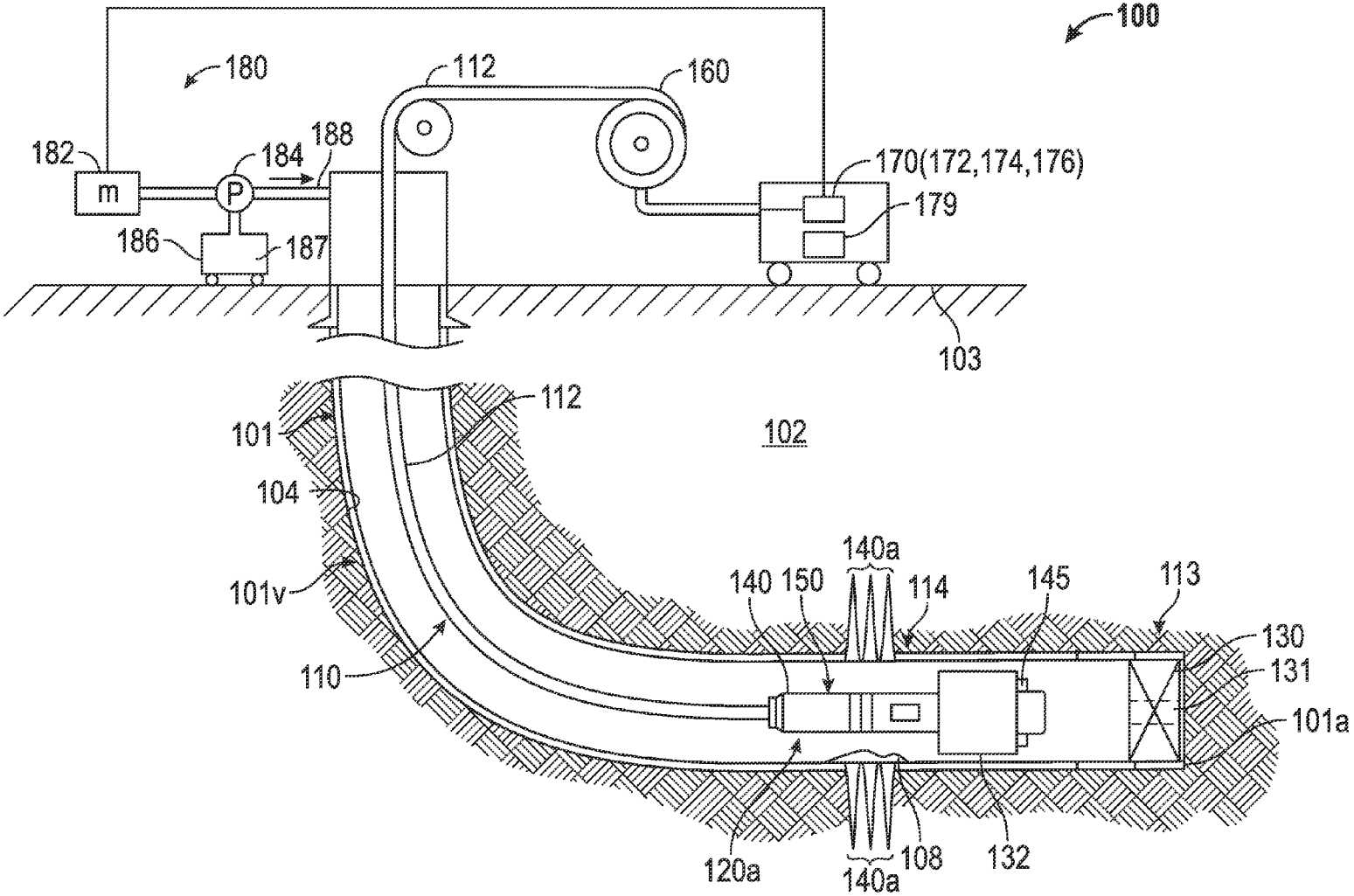
FIG. 3 is a schematic elevation view of the exemplary wellbore system shown in FIG. 2 after a zone uphole of the set plug has been perforated.

It should be understood that FIGS. 1-3 are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. An apparatus for use in a wellbore, comprising:

a downhole tool coupled to a wireline for conveying the tool into the wellbore and for providing a data communication between the downhole tool and a surface location, the downhole tool comprising:

a settable device;

a setting tool for setting the settable device in the wellbore;

an acoustic sensor that provides measurements relating to a downhole parameter of interest by transmitting an acoustic signal ahead of the settable device, the acoustic sensor located axially downhole from the setting tool and the downhole parameter of interest being the location of a downhole obstruction; and a controller for determining the downhole parameter of interest from the measurements and in response thereto altering one of an operating parameter selected from a group consisting of: a flow rate of a fluid supplied into the wellbore for conveying the downhole tool into the wellbore; a tension on the wireline; and a combination of the flow rate of the fluid into the wellbore and the tension on the wireline.

2. The apparatus of claim 1, wherein the controller is configured to automatically alter the one of the flow rate and the tension when the downhole parameter of interest is outside a selected criterion.

3. The apparatus of claim 1 further comprising a perforating gun for perforating a casing in the wellbore.

4. The apparatus of claim 1 further comprising a circuit in the downhole tool that transmits information relating to the measurements to the controller in real time and the controller alters one of the operating parameters in real time in response to the determined parameter of interest.

5. The apparatus of claim 1, wherein the controller selects a flow rate of the fluid supplied and tension on the wireline corresponding to the determined downhole parameter by utilizing one of: a look-up table that provides an optimal flow rate of the supplied fluid and the tension on the wireline or a travel rate of the downhole tool corresponding to the determined downhole parameter; and an algorithm that provides an optimal flow rate and tension on the wireline or a travel rate of the downhole tool corresponding to the determined downhole parameter.

6. A method of performing a completion operation in a wellbore, the method comprising:

conveying a work string into the wellbore, the work string including a downhole tool coupled to a wireline from a surface location, the downhole tool further including a settable device and a setting tool for setting the settable device in the wellbore;

supplying a fluid into the wellbore to convey the downhole tool to a selected location in the wellbore while controlling a tension on the wireline;

determining a downhole parameter of interest by transmitting an acoustic signal ahead of the settable device via an acoustic sensor in the wellbore, the acoustic sensor located axially downhole from the setting tool and the downhole parameter of interest being the location of a downhole obstruction; and altering a parameter relating to conveying of the downhole tool in response to the determined downhole parameter of interest that includes at least one of: altering flow rate of the fluid supplied into the wellbore; altering the tension on the wireline; and a combination of a change in a flow rate of the fluid supplied into the wellbore and the tension on the wireline.

7. The method of claim 6 further comprising:

setting the settable device in the wellbore; and perforating a section of the wellbore uphole of the settable device after setting the settable device.

8. The method of claim 6, wherein altering the parameter relating to the conveying of the downhole tool comprises: an operator altering such parameter at a surface location in response to the determined downhole parameter; and a controller altering such parameter at least in part in response to the determined downhole parameter.

9. The method of claim 6, wherein determining a parameter of interest relating to a condition in the wellbore comprises:

providing a sensor in the wellbore for providing measurements relating to the conveying of the downhole tool;

determining the downhole parameter of interest from the transmitted information; and automatically altering the parameter relating to the conveying of the downhole tool by one of: a manual input to a controller and automatically by a controller.

10. The method of claim 6, wherein altering the parameter relating to the conveying of the downhole tool comprises:

selecting values of the fluid rate and the tension on the wireline from one of a look-up table and using an algorithm that provides an optimal rate of conveyance of the downhole tool into the wellbore while maintaining the downhole parameter of interest within in selected range.

11. A system for performing an operation in a wellbore, the system comprising:

a wireline;

a downhole tool coupled to a wireline;

a fluid supply unit;

a tension unit for controlling tension on the wireline; and wherein the downhole tool comprises:

a settable device;

a setting tool for setting the settable device in the wellbore;

an acoustic sensor that provides measurements relating to a downhole parameter of interest by transmitting an acoustic signal ahead of the settable device, the acoustic sensor located axially downhole from the setting tool and the downhole parameter of interest being the location of a downhole obstruction; and a controller for determining the downhole parameter of interest from the measurements and in response thereto controlling one of the fluid supply unit and the tension unit to control conveying of the downhole tool into the wellbore.

12. The system of claim 11 further comprising a circuit in the downhole tool that provides information from the sensor to the controller in real time and wherein the controller automatically controls one of the fluid supply unit and the tension unit.

* * * * *